United States Patent [19]

Alexander

[11] 4,031,275

[45] June 21, 1977

[54] LOW TEMPERATURE VAPOR SEALING OF ANODIZED ALUMINUM

[75] Inventor: Andrew Alexander, Apollo, Pa.

[73] Assignee: Aluminum Company of America, Pittsburgh, Pa.

[22] Filed: Dec. 22, 1975

[21] Appl. No.: 642,894

[52] U.S. Cl. ..... 427/248 R; 427/248 E; 427/419 R; 204/35 N; 204/38 A; 148/6.27; 148/6.3; 427/343

[51] Int. Cl.[2] ..... C25D 11/24

[58] Field of Search ..... 204/35 N, 38 A; 148/6.1, 6.3, 6.27; 427/419, 248 E, 343 R

[56] References Cited

UNITED STATES PATENTS

| | | | |
|---|---|---|---|
| 3,152,970 | 10/1964 | Jensen | 204/35 N |
| 3,292,243 | 12/1966 | Hofling | 204/35 N |
| 3,374,155 | 3/1968 | Weber | 204/38 |
| 3,791,940 | 2/1974 | Alexander | 204/35 N |
| 3,822,156 | 7/1974 | Wallace | 156/22 |

FOREIGN PATENTS OR APPLICATIONS

| | | | |
|---|---|---|---|
| 443,002 | 2/1936 | United Kingdom | 148/6.27 |
| 639,090 | 6/1950 | United Kingdom | 204/38 A |

*Primary Examiner*—Ralph S. Kendall
*Attorney, Agent, or Firm*—Andrew Alexander

[57] ABSTRACT

A method of forming a low temperature, smudge-free seal on anodized aluminum comprises exposing anodized aluminum to a source of ammonia vapors.

7 Claims, 2 Drawing Figures

LOW TEMPERATURE VAPOR SEALING OF ANODIZED ALUMINUM

BACKGROUND OF THE INVENTION

This invention relates to anodized aluminum and more particularly to low temperature, vapor sealing of anodized aluminum.

Anodized aluminum is usually sealed to render it impervious to elements which could adversely affect the aluminum substrate, because, in many instances, especially in architectural applications, it will be exposed to the atmosphere for many years. It is therefore imperative that the seal be of very high quality to ensure satisfactory service.

Since anodized aluminum normally requires treatment with a sealing solution at or near its boiling point to produce a high quality seal, considerable effort has been expended to develop methods of sealing at a lower temperature. Sealing at lower temperatures is desirable since it would aid in conserving energy resources by reducing the energy required to produce a high quality seal.

High quality seal, as used herein, is defined as a sealed, smudge-free anodized aluminum, which, after being immersed for a period of 15 minutes in a solution containing 2.0 wt. % chromic and 3.5 wt. % phosphoric acid at a temperature of 100° F, has a weight loss of not more than 2 mg./in.$^2$. This seal quality evaluation is known to those skilled in the art as the "acid dissolution test".

Sealed anodized aluminum is resistant to staining. Thus, sealing quality can be determined qualitatively by a dye stain test known as "Standard Method for Measurement of Stain Resistance of Anodic Coatings on Aluminum" (ASTM B136–72). In this method, after conditioning the sealed, anodized surface with a nitric acid treatment, a dye test solution is placed thereon for a period of about 5 minutes, then this test area is washed with water and rubbed with pumice powder. Staining of the anodized finish after this treatment indicates a poorly sealed anodic coating. Conversely, absence of stain indicates a satisfactory seal.

In the prior art, normally a satisfactory seal was produced on anodized aluminum by treating it with an aqueous solution at or near the solution boiling point. The aqueous solution normally comprised distilled or deionized water or a combination of such high purity water with a hydrolyzable metallic salt such as nickel acetate or a substance which would enhance sealing. For example, my previous patent (U.S. Pat. No. 3,791,940) discloses sealing undyed aluminum using metallic salts such as nickel acetate in an aqueous solution at about 212° F or boiling. As another example of materials that were added to high purity water, Wallace U.S. Pat. No. 3,822,156, discloses sealing anodized aluminum in a solution of triethanolamine in hot water, with optimum sealing temperatures being near the boiling range of the solution. Because of smudge formed during these sealing processes, it is taught in these patents that the sealed anodized aluminum is thereafter desmudged with mineral acid, thus requiring an additional step after the sealing operation to produce a smudge-free anodized finish on aluminum.

In the prior art, it is also taught that anodized aluminum can be sealed in a liquid at or close to room temperature (20°–25° C). Yoshimura et al disclose in "Effect of Room-temperature Sealer Containing Ferricyanide and Phosphate on Anodic Aluminum Oxide Film", Journal of Metal Finishing (Japan), Vol. 19, No. 12 (1968), p. 504 that anodized aluminum can be sealed at room temperature in an aqueous solution containing ferricyanide, phosphate, and calcium chloride at a pH of 4.5. This article, however also indicates that immersion of anodized aluminum in a 25% $NH_4OH$ solution, pH of 11.3, does not produce a seal until the temperature of the solution reaches 80° C.

Quite surprisingly, a method has been discovered that will produce a high quality, smudge-free seal on anodized aluminum utilizing ammonium hydroxide ($NH_4OH$) at ambient temperatures but with faster sealing rates being effected by raising the temperature slightly.

SUMMARY OF THE INVENTION

A principal object of this invention is to provide a method for producing a high quality seal on anodized aluminum at a low temperature.

Another object of this invention is to provide a high quality smudge-free seal on anodized aluminum.

Yet another object of this invention is to provide a method for sealing anodized aluminum which reduces the energy requirements necessary for such sealing.

These and other objects will become apparent from the description, drawings and claims appended hereto.

In accordance with these objects, it has been discovered that a high qualtiy, smudge-free seal can be formed at a low temperature on anodized aluminum by exposing it to a source of ammonia vapors.

DETAILED DESCRIPTION OF THE PREFERRED EMBODIMENTS

Anodized aluminum which can be sealed in accordance with the invention may be anodized by conventional methods. For example, it may be anodized by using a sulfuric acid electrolyte well known to those skilled in the art or it can be anodized by using, for example, a sulfophthalic/sulfuric acid electrolyte. The latter electrolyte is disclosed in Kampert U.S. Pat. No. 3,227,639, incorporated herein by reference.

In accordance with the present invention, anodized aluminum can be sealed by exposure to a gaseous media containing ammonia vapors.

Figure 1:
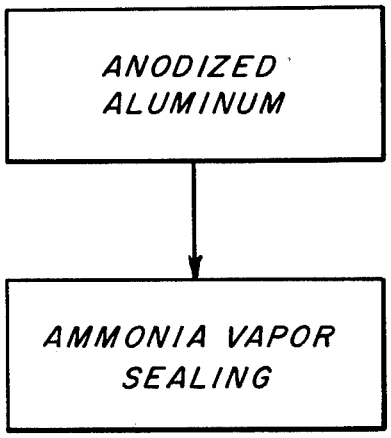
FIG. 1 is a flow chart illustrating the step of sealing anodized aluminum in accordance with the invention.

By reference to FIG. 1, it will be observed that upon anodization of the aluminum, complete sealing can be accomplished in one step. That is, anodized aluminum sealed in accordance with this invention is smudge-free, eliminating any further steps such as chemically removing sealing smudge as noted hereinabove when hot aqueous systems are used. Thus, mineral acid treatments such as taught in my U.S. Pat. No. 3,791,940, referred to hereinbefore, are no longer required to render the finish smudge-free.

By reference to FIG. 2, which indicates the extent of seal as determined by the acid dissolution test (defined hereinabove), a seal can be obtained in ammonia vapors at about room temperature, eliminating any need for thermal energy. However, by further reference to FIG. 2, it will be noted that the amount of sealing can be greatly accelerated by use of a very small amount of energy to provide a small increase in the temperature and concentration of ammonia gas in the vaporous sealing media. As will be understood, the energy requirement to obtain even the highest temperature (125° F) in FIG. 2, which is very suitable for the present invention, is minimal when compared to the hot aqueous systems referred to above.

Figure 2:
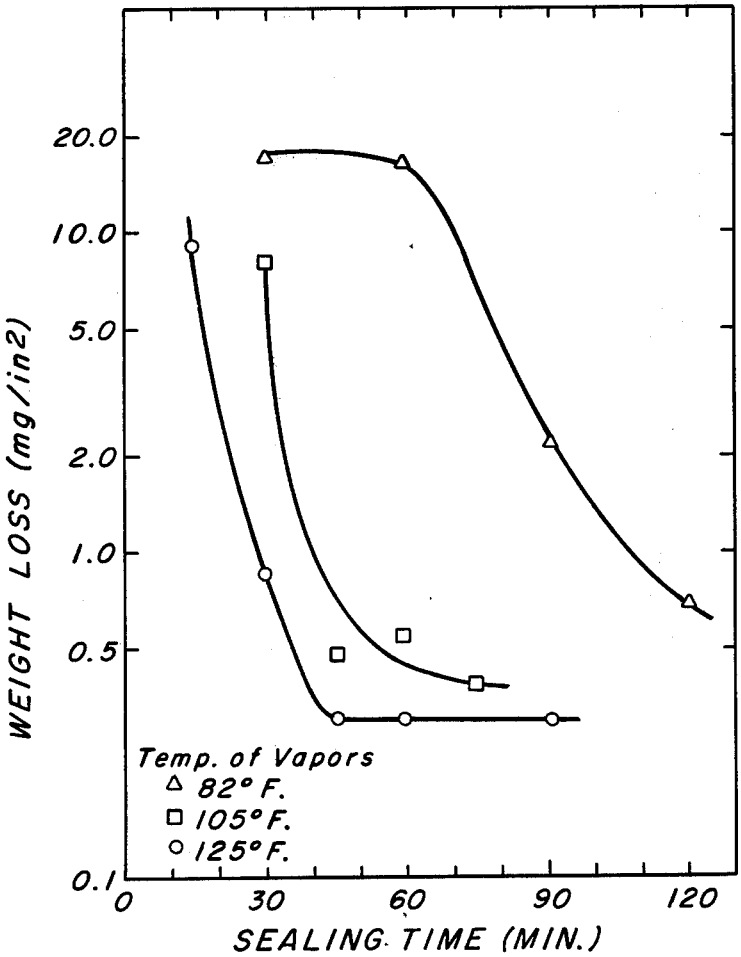
FIG. 2 is a chart illustrating time and temperature related sealing curves typical of the invention.

By further reference to FIG. 2, it will be seen that the quality of seal obtained on anodized aluminum is enhanced by its time of exposure as well as the temperature and concentration of the ammonia vapors. Also, it will be seen from FIG. 2 that ammonia vapors are capable of producing a very high quality seal. That is, as measured by the acid dissolution test, a sealed condition well below the limit of 2.0 mg./in.$^2$ can be easily obtained.

In its broadest aspect, the present invention can produce a sealed condition on anodized aluminum at from below ambient temperatures to temperatures well above ambient. For purposes of this invention, ambient temperature is considered to be in the range of 68° to 82° F. However, as the temperature is increased substantially beyond that required to produce a high quality seal in a convenient period of time, obviously the energy saving benefits of the invention are minimized. Thus, the temperature of the sealing media containing ammonia vapors can be in the range of 55° to 155° F, with a preferred range being 60° to 135° F, and most preferred, 80° to 125° F.

Anodized aluminum can be sealed by exposure to ammonia vapors in the present invention in a time period of about 5 to 80 minutes depending to a certain extent on the temperature and ammonia concentration. A preferred time period for sealing according to this invention is 10 to 50 minutes, with a most preferred time being 20 to 40 minutes at slightly above ambient temperature, i.e. about 105° F. It should be understood that longer seal times are contemplated when sealing in the ammonia gas is performed at about ambient temperature. Since there is no energy requirement at ambient temperature, and thus no cost escalation with seal time, a highly economical method of sealing is ambient temperature, even though sealing times may have to be extended 4 to 8 hours to provide a high quality seal. However, it is believed that this time can be reduced, for example, by increasing the pressure due to the ammonia gas.

With respect to the amount of ammonia gas in the vaporous sealing media, it can vary depending to some extent on the temperature and time period allotted for sealing. A suitable amount of ammonia gas is that which develops about 2.0 lbs./in.$^2$ to 250 lbs./in.$^2$ of pressure in the vaporous sealing media with a preferred pressure range being 5.0 to 75.0 lbs./in.$^2$ in the temperature ranges indicated above.

A convenient source of ammonia gas in the present invention is an ammonium hydroxide solution. Preferably, this source has a concentration of at least 10 wt. % and more preferably 20 to 60 wt. %. In this method of the invention, anodized aluminum is exposed above the ammonium hydroxide solution to the vaporous ammonia gases emanating therefrom. When ammonium hydroxide solution is used, water vapor is present in the sealing media in an amount determined by its vapor pressure above the solution. Water vapor pressure present with the $NH_3$ gas, regardless of source, can range from 0.10 to 5.0 lbs./in.$^2$ and is beneficial as explained hereinafter. Also, when ammonium hydroxide solution is used, the partial pressure due to ammonia gas can range from 2.0 to 250 lbs./in.$^2$ with a preferred range being 5.0 to 75.0 lbs./in.$^2$. A more preferred range of partial pressure due to the ammonia gas is 8.0 to 34.0 lbs./in.$^2$. It will be understood that, according to gas laws of physics, as the temperature and concentration increase so do the partial pressures indicating a greater amount of ammonia gas present above the solution of ammonium hydroxide. Accordingly, from FIG. 2, it will be noted that an increase in the temperature of a given concentration of ammonium hydroxide shortens the time required to produce a high quality seal.

While I do not necessarily wish to be bound by any theory of invention, it is believed that basic solutions have a greater capacity for sealing anodized aluminum than acidic solutions. Thus, it is believed that the high quality seal obtained by the present invention results from amounts of basic solution accumulating in pores of the anodized coating. The basic solution is believed to result from $NH_3$ gas diffusing into water associated with the anodized aluminum surface. That is, there can be water present in pores of the anodized surface into which the $NH_3$ gas can diffuse to form the resultant basic solution in an amount sufficient to effect a seal. It is also believed that having small amounts of water vapor present with the ammonia gas can be beneficial in effecting the seal by assuring that at least some water is present in the anodic coating into which the $NH_3$ gas can diffuse.

As will be known to those skilled in the art, the use of a vaporous sealing media containing ammonia vapors requires that the vapors be confined. Thus, in sealing in accordance with the present invention, a closable container should be used to contain the ammonia gases.

The present invention is advantageous in that it contemplates a high quality seal on anodized aluminum with minimal costs. For example, the energy cost is minimal and in fact can be eliminated if the time to seal, for instance, is extended. Also, there is no cost due to the use of hydrolyzable metallic salts or other such sealing additives or the use of distilled or deionized water. In addition, as noted hereinabove, the use of hydrolyzable metallic salts or additives such as triethanolamine requires that the sealing smudge formed thereby be removed in an additional chemical treatment. The cost of this chemical treatment step has been eliminated since anodized aluminum sealed in accordance with the invention is substantially smudge-free. Thus, it will be seen that the present invention can greatly reduce the overall cost of sealing anodized aluminum.

The following example is further illustrative of the invention.

Specimens of a conventional Anoclad 11 sheet alloy (an Aluminum Association Alloy No. 110 clad with the same alloy) were anodized using conventional practices to produce a bronze colored oxide coating in a sulfophthalic acid/sulfuric acid electrolyte. The specimens were sealed by suspending them in ammonia vapors above a solution of 27–29 wt. % ammonium hydroxide in sealed containers. Four specimens were exposed to the vapors at 82° F for 30, 60, 90 and 120 minutes and four were exposed to the vapors at 105° F for 30, 45, 60 and 75 minutes. Five specimens were treated in the vapors at 125° F for 15, 30, 45, 60 and 90 minutes. The results, as determined by the Dye Stain Test (ASTM B136) and acid dissolution test, of the sealing procedures are as shown in Table I. As noted earlier, the acid dissolution test requires that the sealed anodized aluminum be immersed for a period of 15 minutes in a solution containing 2.0 wt.% chromic acid and 3.5 wt.% phosphoric acid at a temperature of 100° F and that the weight loss be not more than 2 mg./in.$^2$.

Table I

| Temperature of Sealing | Seal Time | Dye Stain (ASTM B136-72) | Acid Dissolution (wt. loss, mg/in$^2$) |
|---|---|---|---|
| | 30 | Failed | 18.5 |
| 82° F | 60 | Failed | 17.5 |
| | 90 | Failed | 2.4 |
| | 120 | Passed | 0.7 |
| | 30 | Failed | 8.1 |
| 105° F | 45 | Passed | 0.5 |
| | 60 | Passed | 0.6 |
| | 75 | Passed | 0.4 |
| | 15 | Failed | 9.2 |
| | 30 | Passed | 0.85 |
| 125° F | 45 | Passed | 0.30 |
| | 60 | Passed | 0.30 |
| | 90 | Passed | 0.30 |

Thus, it can be seen that the present invention provides a high quality seal on anodized aluminum. Also, as the temperature and the concentration of ammonia gas is increased, the time required to provide a high quality seal is shortened considerably. That is, by extrapolation of this data, it can be seen that a high quality seal can be obtained in about 5 minutes by increasing the temperature and concentration of the vapors above the ammonium hydroxide solution.

While the invention has been described in terms of preferred embodiments, the claims appended hereto are intended to encompass all embodiments which fall within the spirit of the invention.

Having thus described my invention and certain embodiments thereof, I claim:

1. A method of forming a low temperature seal on anodized aluminum which comprises exposing said anodized aluminum to ammonia vapors to provide a seal thereto such that immersing said sealed anodized aluminum for a period of 15 minutes in a solution containing 2.0 wt.% chromic and 3.5 wt.% phosphoric acid at a temperature of 100° F produces a weight loss of not more than 2 mg./in.$^2$.

2. The method according to claim 1 wherein the temperature of the ammonia vapors is at least 55° F.

3. The method according to claim 1 wherein the ammonia vapors have a partial pressure of at least 2.0 lbs./in.$^2$.

4. The method according to claim 1 wherein the ammonia vapors are provided by a solution of ammonia hydroxide.

5. The method according to claim 4 wherein the solution is at least 10 wt.% ammonium hydroxide.

6. The method according to claim 4 wherein the solution is 20–40 wt.% ammonium hydroxide.

7. A method of forming a low temperature seal on anodized aluminum which comprises exposing said anodized aluminum to the vapors of a 20–40 wt.% ammonium hydroxide solution at a temperature in the range of 60° to 135° F for at least 10 minutes to provide a seal such that immersing said sealed anodized aluminum for a period of 15 minutes in a solution containing 2.0 wt.% chromic and 3.5 wt.% phosphoric acid at a temperature of 100° F produces a weight loss of not more than 2 mg./in.$^2$.

* * * * *